US008418608B2

(12) United States Patent
Preckel

(10) Patent No.: US 8,418,608 B2
(45) Date of Patent: Apr. 16, 2013

(54) PRINTING SYSTEM FOR PRINTING BOTTLES OR SIMILAR CONTAINERS AND PRINTING DEVICE OR MACHINE HAVING SUCH A PRINTING SYSTEM

(75) Inventor: Katrin Preckel, Gelsenkirchen (DE)

(73) Assignee: KHS GmbH, Dortmund (DE)

( * ) Notice: Subject to any disclaimer, the term of this patent is extended or adjusted under 35 U.S.C. 154(b) by 115 days.

(21) Appl. No.: 13/146,036

(22) PCT Filed: May 10, 2010

(86) PCT No.: PCT/EP2010/002867

§ 371 (c)(1),
(2), (4) Date: Jul. 25, 2011

(87) PCT Pub. No.: WO2010/130397

PCT Pub. Date: Nov. 18, 2010

(65) Prior Publication Data

US 2011/0285768 A1 Nov. 24, 2011

(30) Foreign Application Priority Data

May 11, 2009 (DE) ..... 10 2009 020 702

(51) Int. Cl.
*B41F 17/08* (2006.01)

(52) U.S. Cl.
USPC ..... 101/36

(58) Field of Classification Search ..... 347/6, 20, 347/37–39, 48, 68; 101/36
See application file for complete search history.

(56) References Cited

U.S. PATENT DOCUMENTS

| | | | | |
|---|---|---|---|---|
| 3,269,305 | A | 8/1966 | Rossi | |
| 7,926,933 | B2 * | 4/2011 | Taniuchi et al. | 347/103 |
| 2008/0204506 | A1 | 8/2008 | Nakamura et al. | |
| 2008/0273063 | A1 | 11/2008 | Wouters et al. | |
| 2010/0257819 | A1 * | 10/2010 | Schach | 53/411 |

FOREIGN PATENT DOCUMENTS

| | | |
|---|---|---|
| DE | 102007050490 | 4/2009 |
| EP | 1974928 | 10/2008 |
| WO | 2008/100311 | 8/2008 |
| WO | 2009/018892 | 2/2009 |

* cited by examiner

*Primary Examiner* — An Do
(74) *Attorney, Agent, or Firm* — Occhiuti Rohlicek & Tsao LLP

(57) ABSTRACT

The invention relates to a printing system for printing bottles or similar containers, having at least one electrical print head operating according to the inkjet principle and displaceable along a transport route for the containers for printing the containers disposed at a printing position, and having a supply system for supplying the at least one print head with printing paint or ink.

30 Claims, 7 Drawing Sheets

PRINTING SYSTEM FOR PRINTING BOTTLES OR SIMILAR CONTAINERS AND PRINTING DEVICE OR MACHINE HAVING SUCH A PRINTING SYSTEM

CROSS-REFERENCE TO RELATED APPLICATIONS

This application is the National Stage of International Application No. PCT/EP2010/002867, filed on May 10, 2010, which claims the benefit of the priority date of German Patent Application No. 10 2009 020 702.3, filed on May 11, 2009. The contents of both applications are hereby incorporated by reference in their entirety.

The invention relates to a printing system according to the preamble of claim 1 and to a printing device or machine according to the preamble of claim 15.

Printing systems or printing devices for printing containers using digital electrical print heads which operate according to the inkjet principle are fundamentally known. Also known in particular are printing systems or printing machines in which a plurality of printing positions for holding a respective container to be printed are formed on a container transport element which is driven in rotation about at least one vertical axis, in particular on a rotor which is driven in rotation about a vertical machine axis, at which printing positions the containers are printed using electronically actuated digital print heads which operate according to the inkjet principle. The print heads are in this case provided on a print head transport element which can likewise be driven in rotation about the at least one vertical axis and which is for example the container transporter or an independent transport element. In any case, the print heads are located on a moving part, for example a rotating part, of the respective printing device or machine. This arrangement of the print heads requires special measures which ensure a proper supply of the very fluid printing ink to the print heads, in particular which also ensure that the printing ink is fed to the print heads in each case at a pressure that is constant or as constant as possible and with a consistency and quality that remain constant. Only in this way is it possible to achieve the desired high-quality print on the containers.

The problem addressed by the invention is that of providing a printing system which ensures a high-quality print despite the print heads being arranged on a moving or rotating part of the printing system. In order to solve this problem, a printing system is configured according to claim 1. A printing device or printing machine forms the subject matter of claim 15.

One essential feature of the printing system according to the invention lies in the splitting of this system or of the printing ink supply into a stationary part and a moving, for example rotating, part which comprises the print heads, wherein the stationary part preferably contains at least one main tank for accommodating a sufficient stock of printing ink and in particular also elements for refilling the printing ink and/or for conditioning the printing ink, i.e. in particular controlling the temperature of and/or degassing and/or filtering the printing ink, while the moving or rotating part of the printing system comprises at least one auxiliary tank which forms an inlet tank for the print heads, but preferably also a second auxiliary tank which serves as an outlet tank for the print heads, and these tanks are arranged centrally in relation to the print heads and/or the movement path thereof and are controlled with regard to both the pressure and the filling level.

Further developments, advantages and possible uses of the invention will also become apparent from the following description of examples of embodiments and from the figures. All the features described and/or shown form in principle, per se or in any combination, the subject matter of the invention, regardless of the way in which they are combined in the claims or the way in which they refer back to one another. The content of the claims is also included as part of the description.

The invention will be explained in more detail below with reference to the figures and on the basis of an example of embodiment. In the figures.

Figure 1:
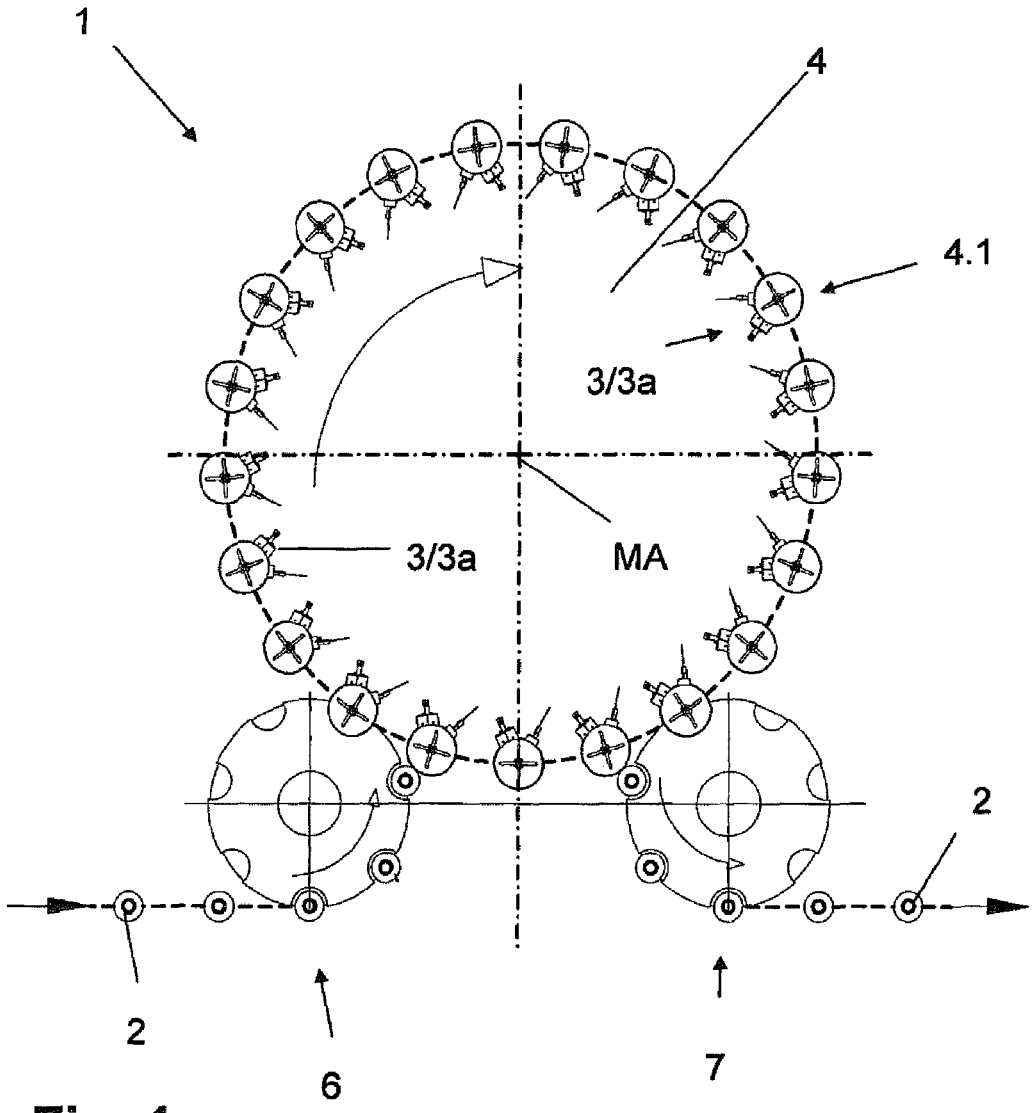
FIG. 1 shows, in a highly simplified diagram and in plan view, a printing device of the rotary type according to the invention for printing bottles or other containers.

In the figures, 1 is a printing device of the rotary type for printing bottles or similar containers 2 using digital print heads 3 operating according to the inkjet principle, having a plurality of nozzles 3.1 which are provided one after the other in a row in the vertical direction on each print head 3 and which can be electrically actuated individually. The application of the printing ink to the nozzles 3.1 takes place by appropriate actuation of electrodes or piezo elements.

In the illustrated embodiment, the printing device 1 consists of a rotor 4 which can be driven in rotation about a vertical machine axis MA and on the circumference of which a plurality of printing positions 4.1 are formed, each of the printing positions having a print head 3. The containers 2 to be printed are fed to the printing positions 4.1 via a container feed 6. The printed containers are removed from the respective printing position 4.1 at a container discharge 7.

In the illustrated embodiment, a print head 3 is provided at each printing position 4.1. The printing of the containers 2 takes place at the printing positions 4.1 in a line-by-line manner by a relative movement of the container 2 relative to the print head 3, namely in the illustrated embodiment in that each container 2, oriented with its container axis in the vertical direction, i.e. parallel to the axis of rotation of the rotor 4, is rotated in a controlled manner about its container axis during the printing operation.

One particular problem caused in particular by the print heads 3 being arranged on the rotor 4 which is driven in rotation about the vertical machine axis lies inter alia in the proper provision of the printing ink to the individual print heads 3. For instance, for trouble-free operation of the print heads 3 and in particular also for the quality of the print, it is necessary that the individual print heads 3 or the nozzles 3.1 thereof are not only supplied with a sufficient quantity of printing ink but rather the printing ink must reach the print heads or the nozzles thereof at a predefined pressure, namely in general at a slight underpressure or overpressure compared to the ambient pressure. Despite the rotating design of the printing device 1, this supply of printing ink to the print heads 3 is ensured in an optimal manner by the printing system 5 which will be described in more detail below in connection with FIGS. 2 and 3 and which is generally denoted 5 in said figures. The print heads to be used ideally are those known as so-called drop-on-demand print heads.

Figure 2:
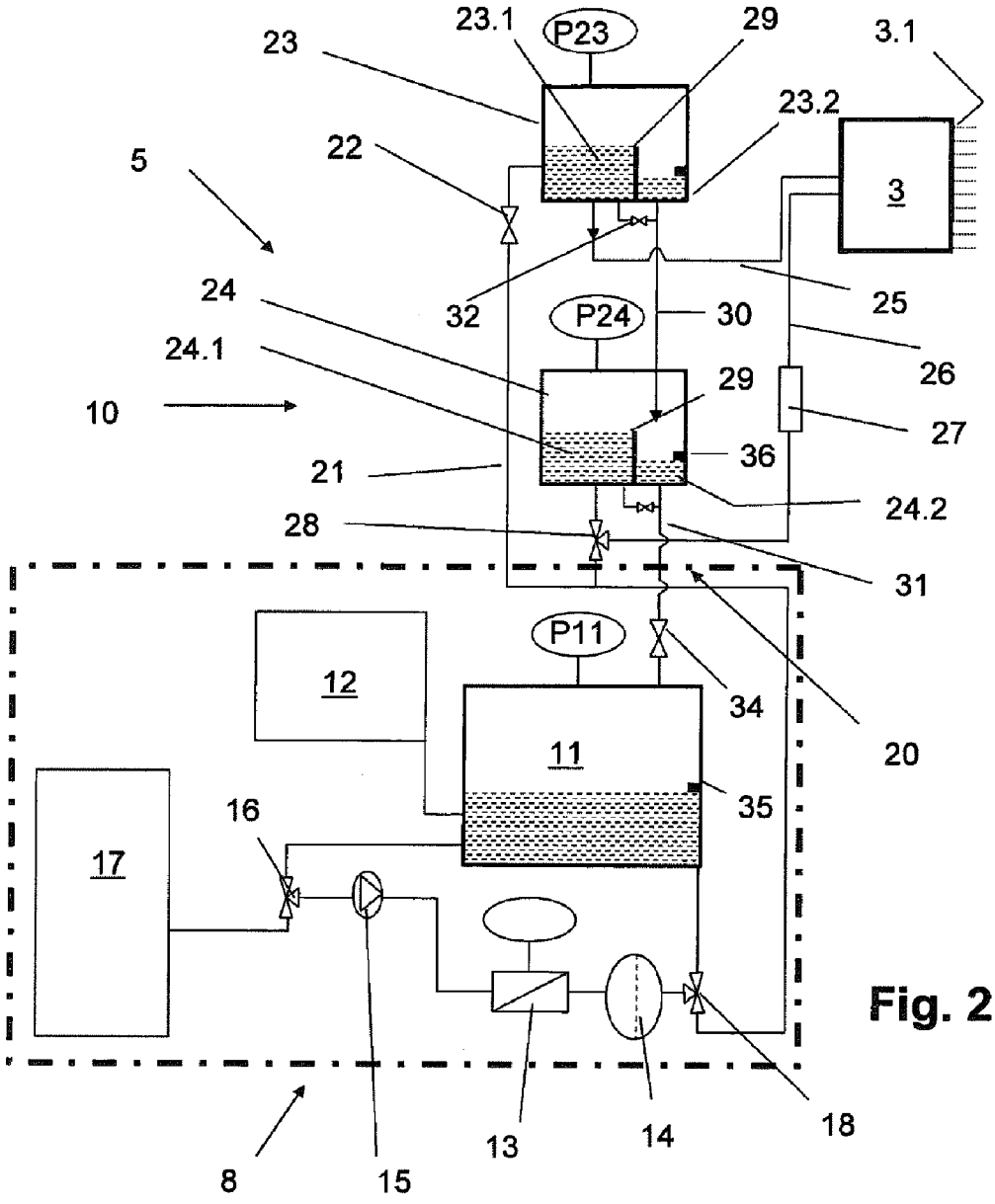
FIG. 2 shows, in a simplified functional diagram, essential elements of the printing system of the printing device of FIG. 1 together with one of the print heads.
Figure 3:
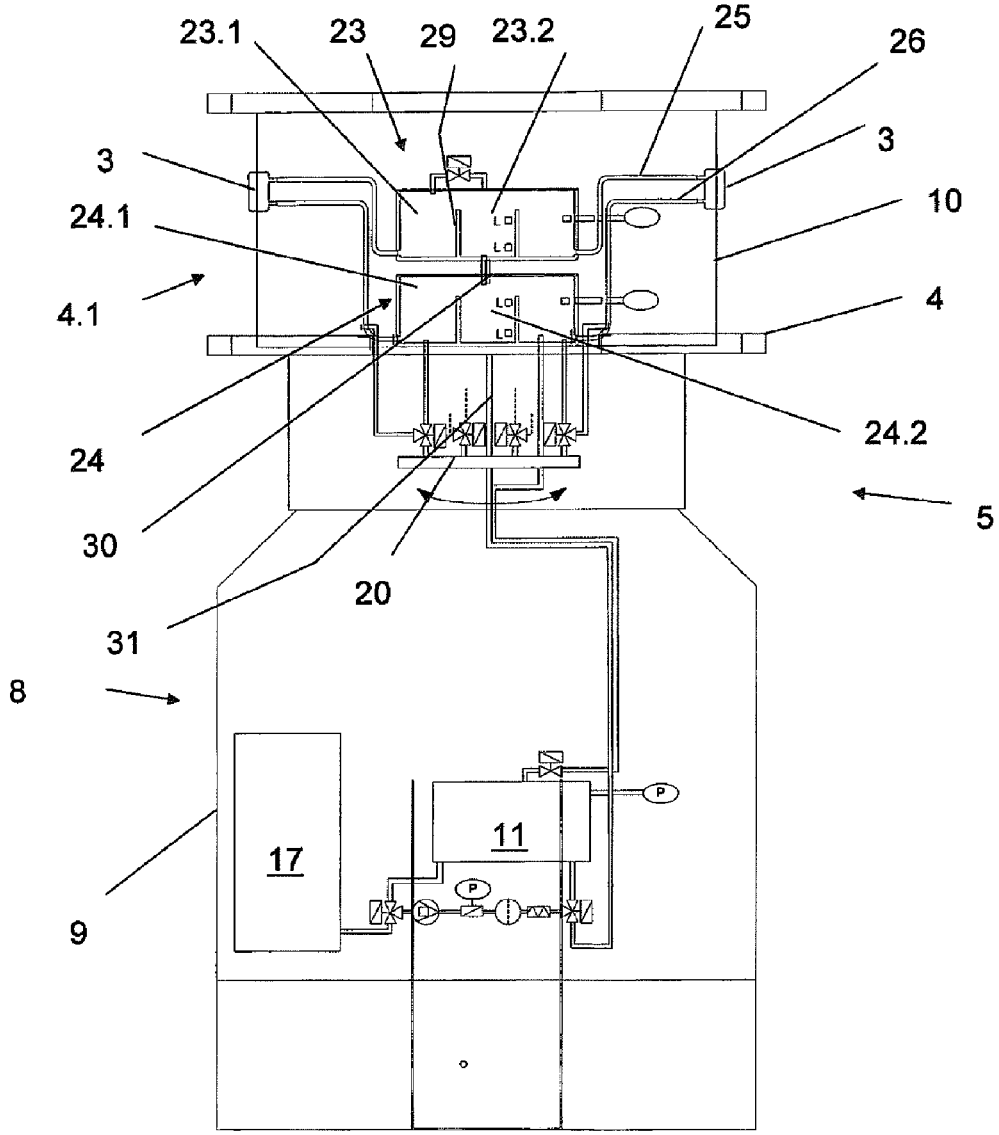
FIG. 3 shows, in a simplified diagram and in vertical section, the rotating and the static part of the printing system of FIG. 2.

In principle, the printing system 5 according to the invention consists of two components, namely of the static part denoted 8 in FIGS. 2 and 3, which is accommodated in the machine frame 9 of the printing device 1 that does not rotate with the rotor 4, and of the rotating part 10 which is provided on the rotor 4 and which comprises inter alia also the print heads 3. Terms used for elements in the figures have the same meaning, even if these are not mentioned even once in the respective description.

The static part 8 of the printing system comprises inter alia a main tank 11 for accommodating a stock of printing ink, as well as all the functional elements for conditioning the printing ink, i.e. inter alia a temperature module 12 for constantly controlling (heating or cooling) the temperature of the printing ink in the main tank 11 and a degasser 13 and a filter 14 in a first printing ink circuit for constantly controlling the temperature of, degassing and filtering the printing ink, said first printing ink circuit comprising a conveying and circulating pump 15 and including the main tank 11. The main tank 11, partially filled with the printing ink, is subjected to a controlled pressure P11 during the printing operation, namely for example, during normal printing operation, to a pressure P11 which is somewhat lower than the ambient or atmospheric pressure. An underpressure has the advantage that it aids the desired degassing of the media, in particular of the ink. A slight overpressure is also conceivable, but cannot be used in the variant shown.

The static part 8 of the printing system furthermore comprises a refilling valve 16, via which the refilling of printing ink into the printing system 5 from cartridges 17 is possible. Via a multiway valve 18, which is arranged in the printing ink circuit of the static part 8 in the flow direction downstream of the filter 14 and upstream of the main tank 11, and via a line 19 connected to the valve 18 and a rotary connection 20, the static part 8 of the printing system 5 is connected to a flow line or supply line 21 of the rotating part 10 of the printing system 5, said line containing a valve 22.

The rotating part 10 of the printing system comprises inter alia two auxiliary tanks 23 and 24, of which the auxiliary tank 23 serves as an inlet tank 23 or as a source for the printing ink supplied to the print heads 3, and of which the auxiliary tank 24 serves as an outlet tank or as a drain for receiving the printing ink which is not required during printing and which has flowed through the print heads 3. The two auxiliary tanks 23 and 24 are each of circular shape and are provided centrally, i.e. coaxial to the machine axis MA and arranged one above the other in the vertical direction on the rotor 4, namely with the auxiliary tank 23 above the auxiliary tank 24. The individual print heads 3 are arranged in a manner distributed around the auxiliary tanks 23 and 24. The supply line 21 opens via the valve 22 into the auxiliary tank 23. The auxiliary tank 23 is respectively connected via a line 25 to a connection terminal of the respective print head 3, said connection terminal serving as inlet. A connection terminal of each print head 3 which serves as outlet is connected via a line 26 containing a pressure reducer 27 to a multiway valve 28, via which optionally a connection of the line 26 to the auxiliary tank 24, a connection between the auxiliary tank 24 and the line 21 or via the rotary connection 20 to the line 19 or else a connection between the line 26 and the line 21 or via the rotary connection to the line 19 is possible. In normal printing operation, the valve 28 is controlled in such a way that a connection between the line 26 and the auxiliary tank 24 exists via this valve. In the illustrated embodiment, the two auxiliary tanks 23 and 24 are moreover of identical design.

Each auxiliary tank 23 and 24 comprises means by which the pressure in the auxiliary tank 23 and 24, which is in each case partially filled with the printing ink during the printing operation, and in particular also the pressure in the lines 25 and 26 and thus at the connection terminals of the print heads 3 is precisely set so that the pressure P23 in the auxiliary tank 23 is somewhat greater than the pressure P24 in the auxiliary tank 24, but the pressure P23 is for example slightly lower than the atmospheric pressure. This pressure control means on the one hand that the printing ink flows through the print heads 3 during the printing operation, i.e. the quantity of printing ink supplied to each print head 3 via the line 25 but not required for the printing operation is discharged from the print head 3 via the line 26 thereof. The volume flow of printing ink to each print head 3 from the auxiliary tank 3 and also from each print head 3 to the auxiliary tank 24 can be set by an appropriate choice of pressures P23 and P24.

In order to achieve conditions which are independent or substantially independent of the rotational speed of the rotor 4 during the printing operation, not only are the two auxiliary tanks 23 and 24 provided centrally on the rotor 4 and the print heads 3 provided in each case around the auxiliary tanks 23 and 24 at the same radial distance from said auxiliary tanks, but also the lines 25 and 26 leading to the print heads 3 and provided individually for each print head 3 are installed on the rotor 4 in the same way for all the print heads 3, for example in such a way that these lines run radially or substantially radially relative to the vertical machine axis MA.

The auxiliary tanks 23 and 24 are furthermore equipped with means which ensure an exact filling level of the printing ink in each auxiliary tank 23 and 24 during operation of the printing device 1. In the illustrated embodiment, these means are formed by providing a circular barrier or an overflow 29 in the interior of each circular auxiliary tank 23 and 24, which barrier or overflow concentrically surrounds the machine axis and separates the tank interior 23.1 or 24.1 serving to accommodate the printing ink from a circular collecting chamber 23.2 or 24.2 which is likewise formed in each auxiliary tank 23 and 24 and which serves for collecting excess printing ink. The collecting chambers 23.2 and 24.2 are provided internally, i.e. are surrounded by the associated tank interior 23.1 or 24.1.

The printing system is operated in such a way that, in each auxiliary tank 23 and 24, a given flow of printing ink constantly flows from the tank interior 23.1 or 24.1 via the overflow 29 into the associated collecting chamber 23.1 or 24.1. The collecting chambers 23.2 and 24.2 are connected to the main tank 11, namely, in the illustrated embodiment, in such a way that the collecting chamber 23.2 is connected via a line 30 and a pressure reducer (not shown) to the collecting chamber 24.2 and the latter is connected via a line 31, via the rotary connection 20 and via a control valve 34 to the main tank 11.

During operation, the printing system is furthermore controlled, namely inter alia by appropriate actuation of the pump 15 and of the valves 18, 22 and 34, in such a way that not only is the main tank 11 partially filled with the printing ink in a filling level-controlled manner, i.e. printing ink is refilled from the cartridge 17 connected to the refilling valve, via this refilling valve, the pump 15, the degasser 13, the filter 14 and the valve 18, into the main tank 11 when the printing ink level in the main tank 11 falls below a predefined level, but rather the system is also operated in such a way that each collecting chamber 23.2 and 24.2 is also filled with printing ink in a filling level-controlled manner. To this end, filling level sensors 35 (main tank 11) and 36 (collecting chambers 23.2 and 24.2) are provided both on the main tank 11 and on the collecting chambers 23.2 and 24.2.

In order to empty the auxiliary tanks 23 and 24 or the tank interiors 23.1 and 24.1, each tank is provided with an emptying valve 32, via which the tank interior 23.1 or 24.1 can be connected to the outlet of the associated collecting chamber 23.2 or 24.2 or to the corresponding line 30 or 31, said emptying valve nevertheless being closed during normal operation of the printing device. During printing operation of the printing device 1, the printing ink circulates in the printing system 5 in two circuits, namely in the first printing ink circuit of the static or stationary part 8, which includes the pump 15, the degasser 13, the filter 14 and the main tank 11, and in a second printing ink circuit which includes the static part 8 and the rotating part 10 of the printing system and also the print head 3.

In this second printing ink circuit, therefore, the printing ink flows for example from the auxiliary tank 23, through the print heads 3, then passes back via the valve 28 to the auxiliary tank 24 and from this auxiliary tank via the overflow 19 and via the collecting chamber 24.2 to the main tank 11, from which the printing ink is then fed back to the auxiliary tank 23 via the pump 15, the degasser 13, the filter 14 and the appropriately set valve 18, the connected line 19, the rotary connection 20 and the line 21. Both printing ink circuits thus include the temperature-controlled main tank 11, the degasser 13 and the filter 14, so that the printing ink in these printing ink circuits is constantly conditioned, i.e. inter alia is kept at a quality and temperature level required for optimal printing. The printing device 1 or the printing system 5 of this machine may be controlled in such a way that, during the printing operation, the printing ink flows simultaneously through both printing ink circuits. However, it is also possible to control the printing system 5 in such a way that, during the printing operation, only the second printing ink circuit, which includes the static part 8 and the rotating part 10, is activated at least primarily, while the first printing ink circuit of the printing system is activated for a quicker and more intensive conditioning of the printing ink when no additional printing ink has to be conveyed to the auxiliary tank 23.

The two-part design of the printing system, i.e. the separation into the static part 8 and the rotating part 10, has considerable advantages:

- The pump 15 and all the functional elements necessary for conditioning the printing ink can be accommodated in the static part 8, as a result of which the number of components on the rotor 4 and the volume of the latter can be reduced.
- Mechanical vibrations, which are caused by the pump 15 and other motor-driven functional elements (e.g. including vacuum pumps) or by the drive thereof and which may adversely affect the printing result, are kept away from the rotor 4.
- Via the refilling valve 16, new printing ink can be refilled into the printing system from the respective cartridge 17 without any problem, wherein the refilled printing ink is pretreated at least in the degasser 13 and in the filter 14 before entering the printing system 5.
- By using the two auxiliary tanks 23 and 24, which are arranged centrally on the rotor 4 and are designed in a rotationally symmetrical manner in relation to the vertical machine axis, a homogeneous distribution is obtained, in particular including the pressure distribution of the printing ink at the connection terminals of the print heads 3.
- By regulating the pressures P23 and P24, both the pressure of the printing ink at the print heads 3 and at the nozzles 3.1 thereof and the rate at which the printing ink flows through the print heads 3 can be controlled or regulated in a manner taking account of the arrangement of the print heads 3 in relation to the auxiliary tanks 23 and 24 and as a function of the rotational speed of the rotor.
- By using the auxiliary tanks 23 and 24, the print heads 3 are moreover decoupled from any pressure fluctuations or pressure surges in the supply and/or discharge of the printing ink, and as a result any adverse effects on the quality of the respective print due to such pressure fluctuations are avoided.
- By regulating the level of printing ink in the tank interiors 23.1 and 24.1, constant pressure conditions are moreover obtained at the connection terminals of the print heads 3, thus resulting in a reproducible optimal print quality.
- Due to the circulation of the printing ink, in particular also in the rotating part 10, undesirable drying of the printing ink and disruptions in function brought about thereby are avoided.

In order to achieve conditions which are independent of the rotational speed of the rotor 4 in the region where the printing ink is diverted from the respective collecting chamber 23.2 or 24.2 via the line 30 or 31, the lines 30 and 31 and the connections thereof are in each case arranged coaxial to the machine axis MA. The auxiliary tanks 23 and 24 once again form respectively the radially outer tank interior 23.1 and 24.1 in relation to the machine axis MA and the inner collecting chamber 23.2 and 24.2 in relation to the machine axis MA.

Of course, it is possible to flush and to clean the print heads 3 or the nozzles 3.1 in a maintenance cycle. To this end, by suitably actuating the printing system 5 and in particular also the various valves, printing ink is pumped or conveyed at increased pressure through the print heads 3, namely from the static part 8 via the line 19 and via the rotary connection 20 to the rotating part 10 and there for example via the line 26 to the individual print heads 3, at the nozzles 3.1 of which there exits at least some of the printing ink conveyed at high pressure for flushing and cleaning purposes.

Figure 4:
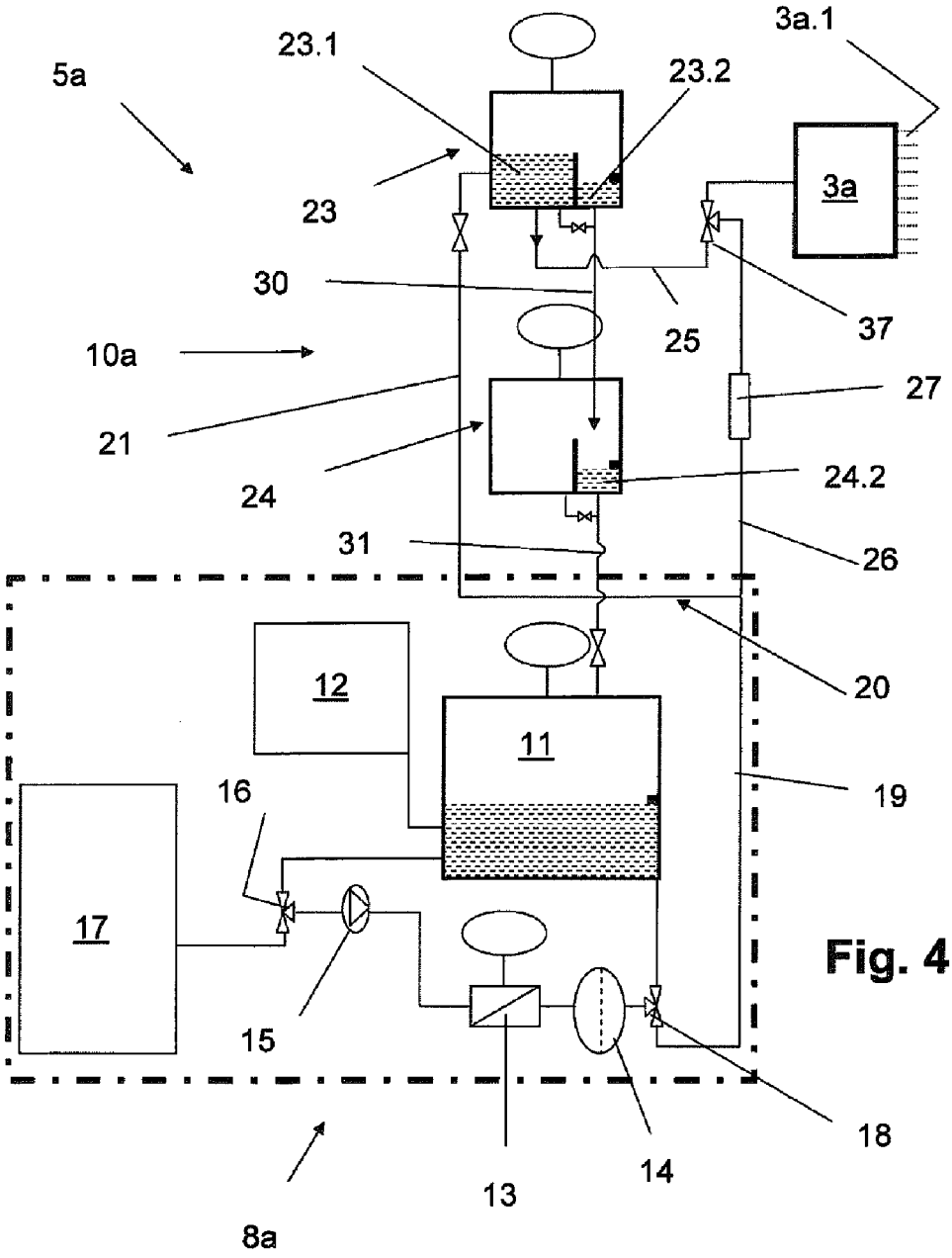
FIG. 4 shows, in a diagram similar to FIG. 2, a further embodiment of the printing system according to the invention.

FIG. 4 shows, in a diagram like that of FIG. 2, the printing system 5*a* of a printing device. The printing system 5*a* once again consists of the stationary part 8*a* and the rotating part 10*a*, wherein the stationary part 8*a* is identical to the stationary part 8 of the printing system 5 of FIG. 2. The rotating part 10*a* comprises, on the rotor which can be driven in rotation about a vertical machine axis MA, electrically actuated digital print heads 3*a* which operate according to the inkjet principle in the same way as the print heads 3 and which in each case comprise a plurality of nozzles 3*a*.1 for the controlled dispensing of printing ink, which nozzles are provided one after the other in a vertical axis direction, i.e. in an axis direction parallel to the machine axis MA. In a manner differing from the print heads 3, the print heads 3*a* are designed as print heads having a static printing ink supply, i.e. as so-called "end shooter print heads", which in each case have just one terminal connection via which the printing ink is supplied at a predefined pressure, for example at a slight underpressure. With regard to the setting of an overpressure, what has been stated above applies.

The rotating part 10*a* of the printing system once again comprises the two auxiliary tanks 23 and 24, although only the auxiliary tank 23 or the tank interior 23.1 thereof is connected to the single input of each print head 3*a* via a respective line 25 and a multiway valve 37 additionally provided in this line. Also connected to the valve 37 is the line 26 containing the pressure reducer 27, which in this embodiment is connected directly to the line 21 or else is connected via the rotary connection 20 directly to the line 19. In this embodiment, the auxiliary tank 24 does not serve as a drain for receiving printing ink fed back from the print heads, but rather only the collecting chamber 24.2 of the auxiliary tank 24 is used to receive the excess printing ink from the collecting chamber 23.2 and to divert this printing ink to the main tank 11 of the stationary part 8*a*.

Two printing ink circuits are also possible in the printing system 5*a*, namely a first circuit within the static part 8*a*, which once again includes the pump 15, the degasser 13, the filter 14 and the main tank 11, and a second printing ink circuit which includes the static part 8*a* and the rotating part 10*a*. This second printing ink circuit then extends for example from the tank interior 23.1 of the auxiliary tank 23, via the overflow 19 therein, into the collecting chamber 23.2, from there into the collecting chamber 24.2, from there into the main tank 11 and from the latter via the pump 15, the degasser 13, the filter 14 and the lines 19 and 21 back to the auxiliary tank 23 and to the tank interior 23.1 therein.

Also in the pressure system 5*a*, therefore, the printing ink is constantly conditioned, i.e. degassed, filtered and temperature-controlled, i.e. either heated or cooled according to the respective requirements, not only in the first printing ink circuit which runs only in the static part 8*a*, but also in the second circuit which includes both the static part 8*a* and the rotating part 10*a* of the printing system 5*a*.

It has been assumed above that the two auxiliary tanks 23 and 24, which are of identical design and of circular shape, are provided in a manner offset from one another in the vertical direction, i.e. in the machine axis.

Figure 5:
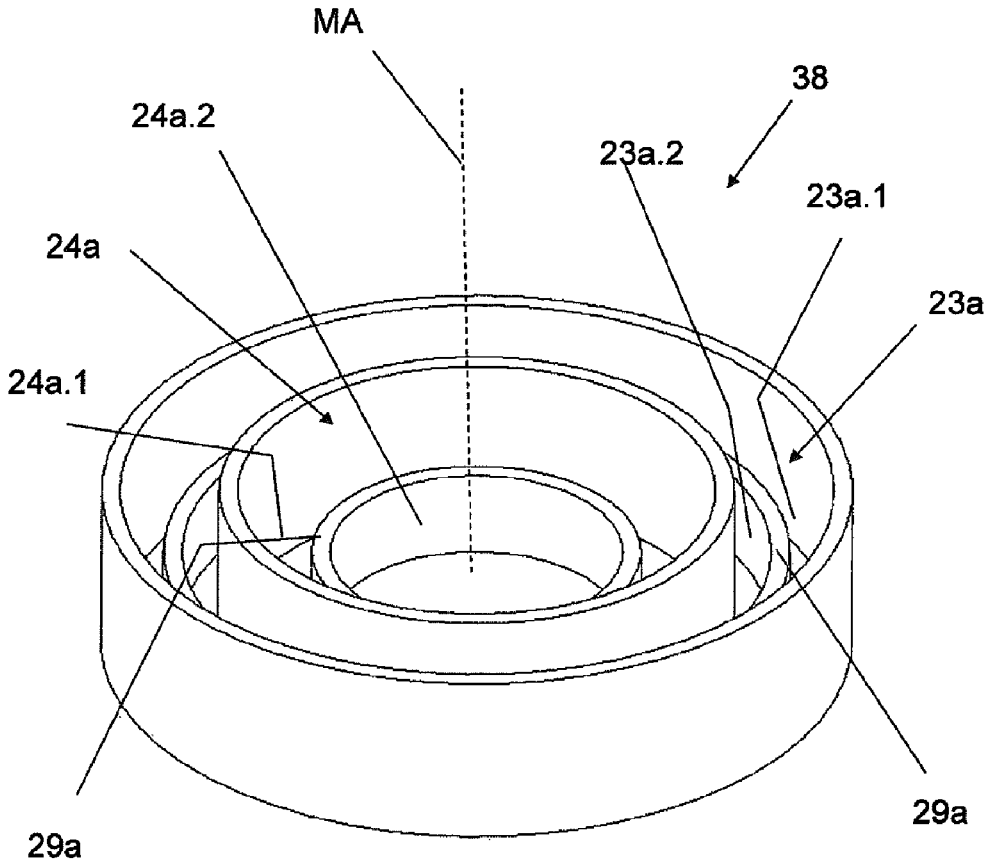
FIG. 5 shows, in a perspective detail view, the inlet or outlet tank of a printing system of the invention.

Of course, other embodiments are also conceivable. For instance, FIG. 5 shows in a perspective view a tank arrangement 38 which forms the two individual tanks 23*a* and 24*a*, which are once again of circular shape and surround the machine axis MA in a concentric manner but which, unlike the embodiment described above, are not offset from one another in the direction of the machine axis MA but rather are arranged in such a way that one individual tank, for example the auxiliary tank 23*a*, surrounds the auxiliary tank 24*a* in an annular manner. By virtue of the overflow 29*a*, the auxiliary tanks 23*a* and 24*a* are once again divided into a tank interior 23*a*.1 and 24*a*.1 and a collecting chamber 23*a*.2 and 24*a*.2.

Figure 6:
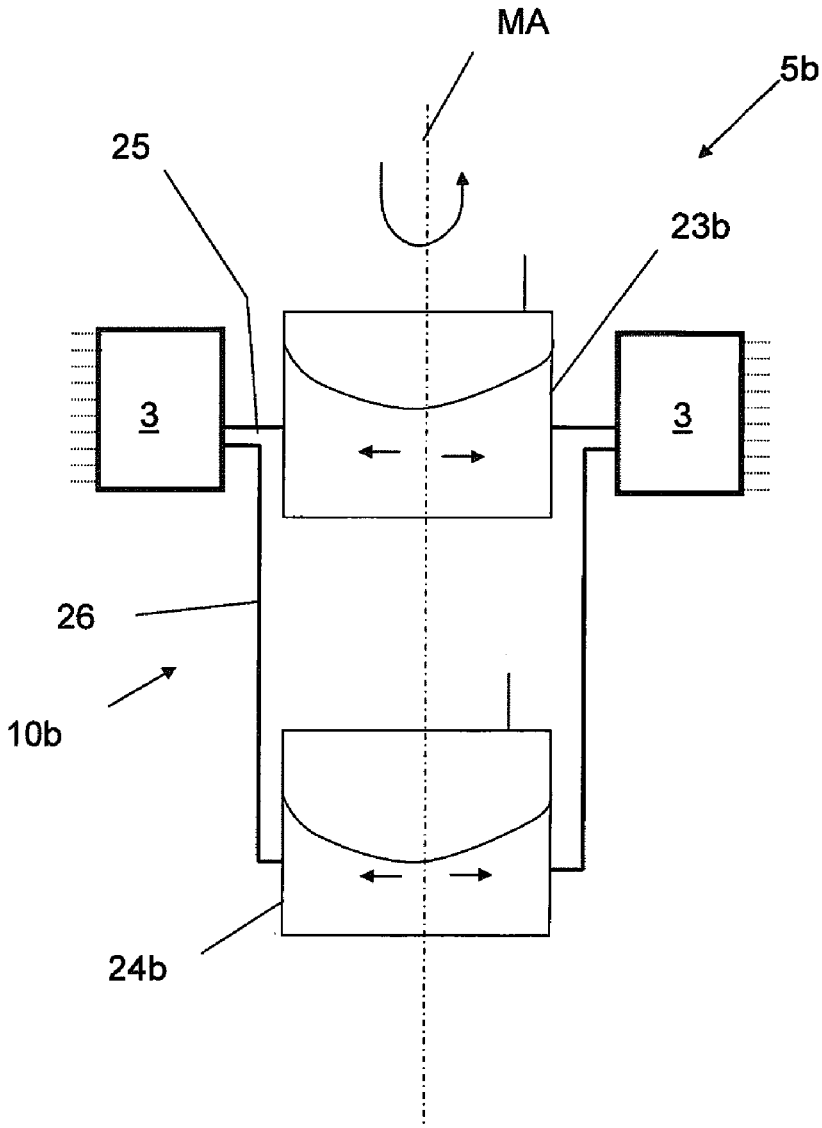
FIG. 6 shows, in a schematic diagram, the inlet and outlet tank of the rotating part of a printing system of the invention together with two print heads of this system.

FIG. 6 shows once again, in a highly simplified diagram, the rotating part 10*b* of a printing system 5*b* comprising the print heads 3, together with the centrally arranged auxiliary tanks 23*b* and 24*b* which are offset from one another in the direction of the machine axis MA and of which the auxiliary tank 23*b* once again forms the printing ink source or inlet tank for the print heads 3 and the auxiliary tank 24*b* forms the printing ink drain or outlet tank for the print heads 3. Only two print heads 3 are shown. In actual fact, the printing system comprises a large number of print heads 3. The two auxiliary tanks 23*b* and 24*b* are arranged centrally in relation to the machine axis MA and are designed to be rotationally symmetrical, i.e. cylindrical, around this machine axis MA, but the two auxiliary tanks 23*b* and 24*b* do not have the overflow 29 and the collecting chamber formed by the latter. The parabolic curve of the printing ink level (convex meniscus) produced by the rotational movement of the rotor is clearly shown in FIG. 6.

Changing pressure conditions brought about by a varying rotational speed of the rotor are adapted or compensated by regulating the pressures P23*b* and P24*b* in the auxiliary tanks 23*b* and 24*b* and the differential pressure between said auxiliary tanks, so that a constant flow rate of the printing ink through the print heads 3 is achieved, as well as a constant pressure, for example a constant or stable underpressure (meniscus underpressure) at the nozzles 3.1 of the print heads 3.

It has been assumed above that the respective printing device 1 comprises a printing system 5, 5*a* or 5*b* which allows the printing of the containers 2 with a single printing ink, i.e. with printing ink of one single color. In order to produce a multicolor print using several sets of colors, a plurality of printing devices 1 are then provided one after the other in an installation, wherein one set of colors of the respective multicolor print is then produced in each printing device. At least in the further printing devices following the first printing device, the printing positions 4.1 for orienting the respective container 2 are formed at a marking provided on or applied to the container prior to the actual start of printing, in order thus to ensure that the individual sets of colors forming the multicolor print are applied in the correct position.

In principle, it is also possible to provide on a single printing device a plurality of printing systems 5, 5*a* or 5*b* for a plurality of printing inks of different color, in order thus to provide the container 2 with a multicolor print in its entirety at each printing position 4.1 and/or with multiple sets of colors of a multicolor print which is completed on a further printing device.

Figure 7:
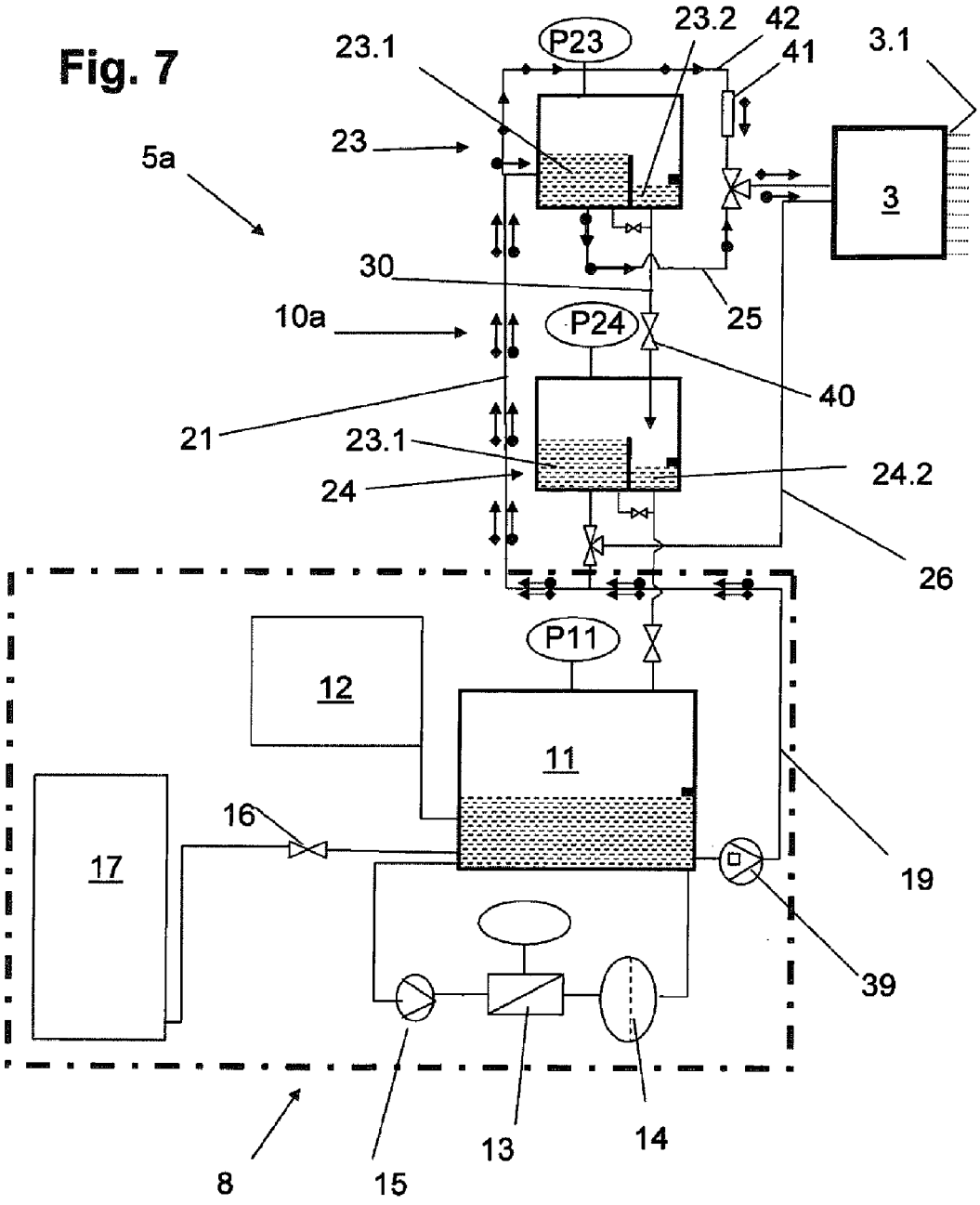
FIG. 7 shows, in a diagram similar to FIG. 4, a further embodiment of the printing system according to the invention with bypass control.

Unlike the previous diagrams, FIG. 7 shows a further advantageous embodiment. In the system shown in FIG. 7, the ink in the static part is constantly conveyed by means of an additional pump 39 through the conditioning section (15, 13, 14) of the system. This process is independent of the ink conveying section in the rotating part of the system via the line 19. Furthermore, the bypass between the auxiliary tank 23.2 and the auxiliary tank 24.2 is in this case actively regulated as a function of the filling level of the auxiliary tank 23.2. As a result, it is possible to open the bypass only when the filling level in the auxiliary tank 23.2 has to be reduced. If the filling level is in the desired range, the bypass valve 40 remains closed. This effectively prevents air from being sucked from the auxiliary tank 23.2 into the auxiliary tank 24.2, and pressures in the containers remain stable.

The path through the lines which is indicated by arrows with a round end represents normal operation in which the pump 39 conveys into the auxiliary container 23 and the excess ink runs through the print head 3 and then into the auxiliary tank 24. The path through the lines which is indicated by the arrows with a polygonal end represents the flushing process in which the pump 39 conveys through a pressure reducer 41, which is provided in the line path 42, directly into the print head 3. In this way, an increased conveying power and a higher pressure is produced, as a result of which the nozzles 3.1 are flushed.

The invention has been described above on the basis of examples of embodiments. It will be understood that numerous changes and modifications are possible without thereby departing from the inventive concept on which the invention is based.

It has been assumed above that the rotating part 10, 10*a*, 10*b* of the printing system is located above the static part 8, 8*a* of the printing system. In principle, in order to achieve a design that is as compact as possible, it is also possible to configure the static part of the printing system in such a way that it entirely or almost entirely surrounds the moving or rotating part of said system, so that ultimately only the print heads protrude above the upper side of the printing system.

It has also been assumed above that the print heads 3 or 3*a* are also provided on the rotor 4, which firstly forms the transport element for the containers 2, i.e. the container transporter, that is to say the rotor 4 is at the same time also the transport element that moves the print heads 3 or 3*a*. However, other embodiments are also conceivable in which the print heads 3 or 3*a* for in each case at least one color or set of colors of a multicolor print are provided on a dedicated transport element (print head transport element) which is moved or rotated about the vertical machine axis MA.

In particular, the pressures P23 and P24 are controlled for example also as a function of the rotational speed and/or acceleration of the rotor 4, so that centrifugal forces exerted on the printing ink are compensated by the pressure regulation.

LIST OF REFERENCES

1 printing device
2 container
3, 3*a* print head
3.1, 3*a*.1 nozzle
4 rotor
4.1 printing position
5, 5*a*, 5*b* printing system
6 container feed
7 container discharge
8, 8*a* static part of the printing system
9 machine frame
10, 10*a*, 10*b* rotating part of the printing system
11 main tank
12 temperature module
13 degasser
14 filter
15 pump
16 refilling valve
17 printing ink cartridge
18 multiway valve
19 line
20 rotary connection
21 line
22 valve
23, 23*a*, 23*b* auxiliary tank or inlet tank
23.1, 23*a*.1 tank interior
23.2, 23*a*.2 collecting chamber
24, 24*a*, 24*b* auxiliary tank or outlet tank
24.1, 24*a*.1 tank interior
24.2, 24*a*.2 collecting chamber
25, 26 line
27 pressure reducer
28 multiway valve
29, 29*a* overflow
30, 31 line
32 emptying valve
34 valve
35, 36 filling level sensor
37 multiway valve
38 tank arrangement
39 pump
40 bypass valve
41 pressure reducer
42 line
MA vertical machine axis
P11, P23, P24 pressure
P23*b*, P24*b* pressure

The invention claimed is:

1. An apparatus for printing on containers, said apparatus comprising:

a printing system that includes:

at least one electrical inkjet print head, said print head being movable along a transport path for the containers for printing on a container arranged at a printing position;

a supply system that is not moved with the print head, the supply system supplying the at least one print head with printing ink, a static part that is not moved with the at least one print head;

a moving part that is moved with the at least one print head; and at least one auxiliary tank for the printing ink, the tank being connected to the at least one print head.

2. The apparatus of claim 1, wherein the moving part of the printing system comprises a plurality of print heads, and wherein the at least one auxiliary tank is provided jointly for all the print heads.

3. The apparatus of claim 1, further comprising means for controlling and/or regulating pressure and/or printing ink level in the at least one auxiliary tank.

4. The apparatus of claim 3, wherein the at least one auxiliary tank comprises:

a tank interior connected to the at least one print head for accommodating the printing ink, and an overflow for regulating printing ink level in the tank interior.

5. The apparatus of claim 3, wherein the means for controlling and/or regulating comprises means for controlling and/or regulating the pressure of the printing ink in the at least one auxiliary tank and/or in the at least one print head as a function of rotational speed of the print heads.

6. The apparatus of claim 3, wherein the means for controlling and/or regulating comprises means for compensating for forces exerted on the printing ink as a result of acceleration thereof, wherein acceleration includes at least one of a change in velocity and a change in direction.

7. The apparatus of claim 1, wherein the moving part of the printing system comprises at least two auxiliary tanks, of which a first auxiliary tank serves as an inlet tank for supplying the at least one print head with printing ink.

8. The apparatus of claim 7, further comprising a second auxiliary tank that serves as an outlet tank for the at least one print head through which the printing ink flows during a printing operation.

9. The apparatus of claim 1, wherein the printing system further comprises:

a transport element for the print heads, the transport element including a rotor driven in rotation about a vertical machine axis; and wherein the at least one auxiliary tank is arranged centrally and/or configured in a rotationally symmetrical manner in relation to the vertical machine axis.

10. The apparatus of claim 9, further comprising at least one line for supplying or discharging the printing ink to or from the at least one auxiliary tank, said at least one line being arranged coaxially with the machine axis.

11. The apparatus of claim 9, further comprising an additional auxiliary tank that is offset from the at least one auxiliary tank in the direction of the machine axis.

12. The apparatus of claim 9, further comprising an additional auxiliary tank that surrounds the at least one auxiliary tank.

13. The apparatus of claim 1, wherein said at least one auxiliary tank is cylindrical.

14. The apparatus of claim 1, wherein the moving part of the printing system is provided above the static part of the printing system.

15. The apparatus of claim 1, wherein, with the exception of the at least one print head, the moving part of the printing system is surrounded by the static part of the printing system.

16. The apparatus of claim 1, wherein the static part of the printing system comprises at least one main tank for the printing ink, and means for refilling with printing ink and/or for conditioning the printing ink.

17. The apparatus of claim 16, wherein said means for refilling and/or conditioning means for controlling temperature of the printing ink.

18. The apparatus of claim 16, wherein said means for refilling and/or conditioning means for degassing the printing ink.

19. The apparatus of claim 16, wherein said means for refilling and/or conditioning means for filtering the printing ink.

20. The apparatus of claim 1, further comprising a printing ink circuit within the static part of the printing system or printing ink supply system.

21. The apparatus of claim 1, further comprising a printing ink circuit that includes the static part and the moving part.

22. The apparatus of claim 1, further comprising:

at least one container transporter that can be driven in rotation;

a plurality of printing positions formed on the container transporter at which the printing of the containers takes place in each case by means of the print head.

23. The apparatus of claim 22, wherein the print heads are provided on a moveable transport element that is rotatable about at least one vertical axis.

24. The apparatus of claim 23, wherein the moveable transport element comprises the container transporter.

25. The apparatus of claim 23, wherein the movable transport element is a transport element independent of the container transporter.

26. The apparatus of claim 22, further comprising additional printing systems, each printing system being associated with a corresponding color or set of colors, whereby the printing systems cooperate to produce a multicolor print on a container.

27. The apparatus of claim 26, wherein the printing systems associated with corresponding colors or sets of colors, and the corresponding print heads thereof, are provided on a common transport element.

28. The apparatus of claim 26, wherein the printing systems associated with corresponding colors or sets of colors, and the corresponding print heads thereof, are provided on different transport elements.

29. The apparatus of claim 22, wherein at least two container transporters are provided sequentially in a container transport direction, and wherein each container transporter is provided with at least one printing system for printing on containers with one color or with a set of colors of a multicolor print.

30. The apparatus of claim 22, wherein each printing position is configured for relative movement between the print head and the container.

* * * * *